US009540076B1

(12) United States Patent
Trail

(10) Patent No.: US 9,540,076 B1
(45) Date of Patent: Jan. 10, 2017

(54) SYSTEM FOR LAUNCH AND RECOVERY OF REMOTELY OPERATED VEHICLES

(71) Applicant: WT INDUSTRIES, LLC, Houston, TX (US)

(72) Inventor: Douglas Patrick Trail, Houston, TX (US)

(73) Assignee: WT INDUSTRIES, LLC, Houston, TX (US)

( * ) Notice: Subject to any disclaimer, the term of this patent is extended or adjusted under 35 U.S.C. 154(b) by 0 days.

(21) Appl. No.: 14/593,045

(22) Filed: Jan. 9, 2015

Related U.S. Application Data

(60) Provisional application No. 61/926,173, filed on Jan. 10, 2014.

(51) Int. Cl.
*B63B 27/00* (2006.01)

(52) U.S. Cl.
CPC ..... *B63B 27/00* (2013.01)

(58) Field of Classification Search
CPC ..... B63G 38/001; B63G 8/14; B63B 35/816; B63C 11/34
USPC ..... 414/137.1, 137.7, 137.8, 138.4, 142.6,414/142.7; 114/312, 330, 331, 254, 268
See application file for complete search history.

(56) References Cited

U.S. PATENT DOCUMENTS 5,140,927 A * 8/1992 Tolefson ..... B63B 39/02 114/244
6,390,012 B1 * 5/2002 Watt ..... B63B 27/36 114/322
6,505,574 B1 * 1/2003 Naud ..... B63B 27/10 114/268
6,588,985 B1 * 7/2003 Bernard ..... B63B 21/22 166/338
6,935,262 B2 * 8/2005 Roodenburg ..... B63C 11/42 114/258
2009/0052992 A1 * 2/2009 Thompson ..... B63C 11/40 405/158
2010/0171637 A1 * 7/2010 Jaffrey ..... H04B 13/02 340/850
2013/0048294 A1 * 2/2013 Hailey, Jr. ..... E21B 33/035 166/341
2013/0333371 A1 * 12/2013 Vigars ..... F03B 13/264 60/495

FOREIGN PATENT DOCUMENTS

GB WO 8907068 A1 * 8/1989 ..... B63B 27/36
JP 60185697 A * 9/1985
JP 09208179 A * 8/1997

* cited by examiner

*Primary Examiner* — Jeanette E Chapman
(74) *Attorney, Agent, or Firm* — Buskop Law Group, PC; Wendy Buskop

(57) ABSTRACT

A launch and recovery management system with a pass through tether for an offshore object. The system turns a free flying remotely operated vehicle system into a tether management controlled system by separately supporting the tether management system frame with an independent load line so the tether or umbilical only passes through the frame going direct to a remotely operated vehicle. A traction system coupled with a constant tension system on the tether management system topside maintains the tether or umbilical directly below the launch and recovery system down to the desired working depth thereby avoiding any slack or impacts of current forces.

10 Claims, 8 Drawing Sheets

SYSTEM FOR LAUNCH AND RECOVERY OF REMOTELY OPERATED VEHICLES

CROSS REFERENCE TO RELATED APPLICATION

The current application claims priority to and the benefit of U.S. Provisional Patent Application Ser. No. 61/926,173 filed Jan. 10, 2014, entitled "SYSTEM FOR REMOTE OPERATED VEHICLE". This reference is hereby incorporated in its entirety.

FIELD

The present embodiments relate to a launch and recovery system with a pass through tether management system for an offshore object.

BACKGROUND

Many underwater operations, such as drilling for and production of oil and gas, installation and maintenance of offshore structures, or laying and maintaining underwater pipelines require the use of a remotely operated vehicle (ROV).

The deployment of an ROV is typically achieved by launching the unit from either a bottom founded or floating host platform or from a dynamically positioned marine vessel dedicated specifically for the purpose of supporting an ROV's and other installation and subsea intervention equipment, e.g. a multi service vessel (MSV).

Both bottom founded and floating host platforms can be fixed in position at the site and are normally engaged in collateral activities such as drilling and offshore production or construction. Thus, the operations of the ROV can be limited according to the distance that the ROV can travel from the host platform as well as by restrictions in operating periods due to the collateral activities of the host platform.

In the case of dedicated vessel deployment such as an MSV, significant costs can be associated with operation of a fully founded marine vessel and its mobilization to and from the ROV work site. Typically, a dedicated MSV may have a crew of twenty, large AHC cranes, and other considerable cost not directly related to the operation of the ROV.

ROV operation and monitoring can be controlled from the host platform or MSV by means of an umbilical line between the host platform or MSV and the TMS (Tether Management System) which stores a limited amount of tether to connect to the ROV. It can be seen from this that the operational distance of the ROV can be directly related to the length of the tether capacity on the TMS unit.

A need exists for an improved launch and recovery system that utilizes pass through tether management system concepts and advantages while addressing most prominent drawbacks of current systems.

A further need exists for an improved launch and recovery system that can be containerization for standard shipping that can include simple accurate active heave compensation and that has passive guidance for heavy weather deployments.

A further need exists for an improved launch and recovery system that include redundant passive overload that eliminates the need for hydraulic power units and can have easy dead ROV recovery capability.

A further need exists for a pass through tether management system with a launch and recovery system connected to a processor with data storage and a power supply, and a tether management component connected to the launch and recovery system enabling a remotely operated vehicle (ROV) to be lifted and deployed in water without the need for an armored umbilical.

The present embodiments meet these needs.

BRIEF DESCRIPTION OF THE DRAWINGS

The detailed description will be better understood in conjunction with the accompanying drawings as follows.

Figure 1:
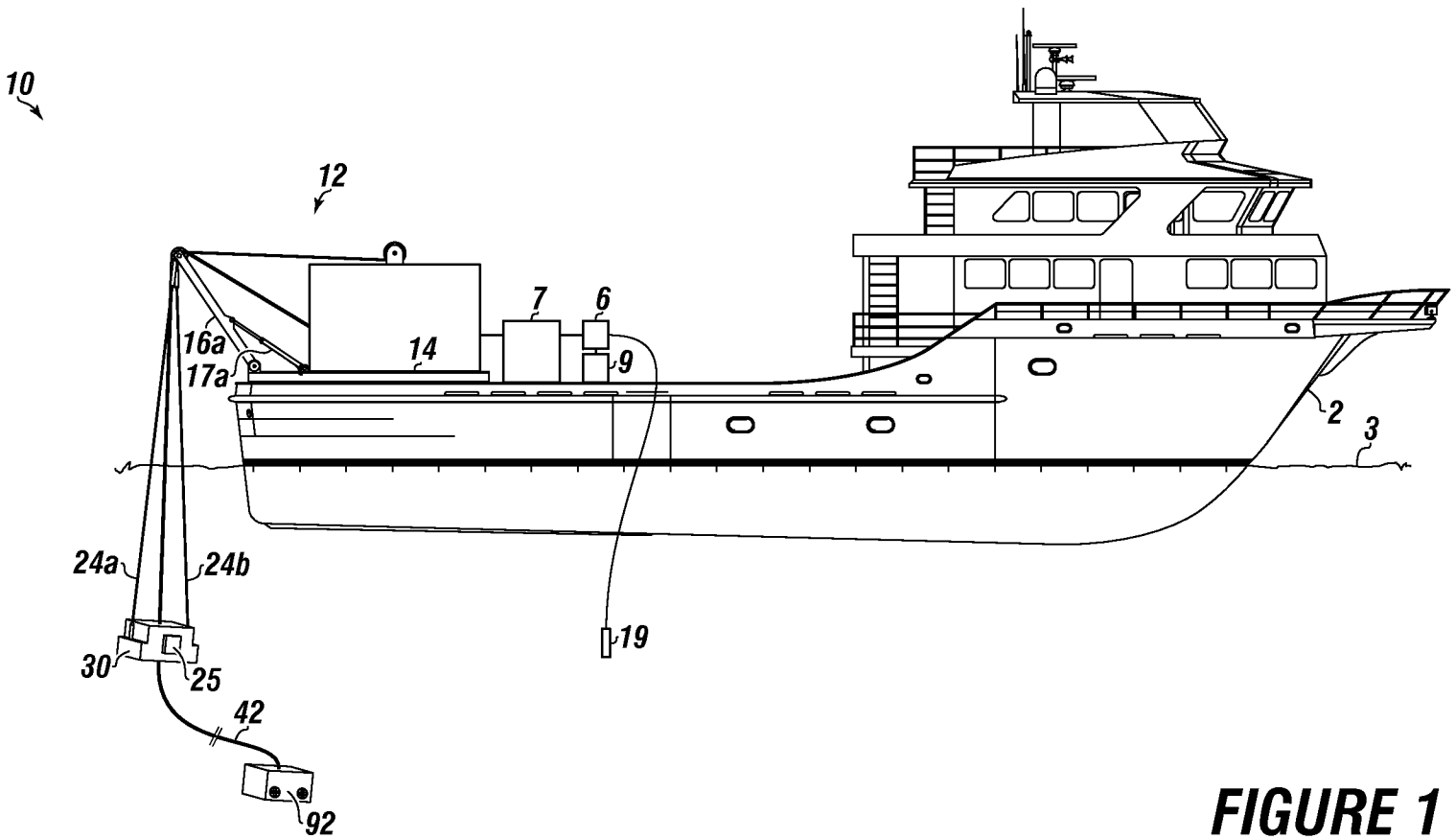
FIG. 1 depicts a side view of a pass through tether management system as it is used on an offshore object.

The present embodiments are detailed below with reference to the listed Figures.

DETAILED DESCRIPTION OF THE EMBODIMENTS

Before explaining the present system in detail, it is to be understood that the system is not limited to the particular embodiments and that it can be practiced or carried out in various ways.

The present embodiments relate to a launch and recovery system (LARS) with a tether management system (TMS) utilizing a pass through (PT) tether for an offshore object. Herein, the embodiments can be referred to as pass through tether management system (PT-TMS).

The embodiments can turn a free flying system into a "TMS controlled" system by separately supporting the TMS frame (and/or lift frame) with an independent load line so the tether or umbilical only passes through the frame going direct to the ROV.

A traction system in the PT-TMS coupled with a constant tension system on the LARS topside maintains the tether or umbilical directly below the LARS down to the desired working depth thereby avoiding any slack or impacts of current forces.

The traction system can be controlled by direct cable, a communication line with battery power, or battery power with wireless communications such as an acoustic modem.

The embodiments eliminate the need for armored umbilicals to support the TMS. The embodiments significantly reduce the winch size, power, and deck space. The embodiments, therefore, provide an alternative that can reduce the current total ROV systems deck weight in excess of 40 percent. The embodied system allows for the use of a smaller transport vessel and thereby reduces harm to the environment through conservation of resources and reduction of harmful emissions. A further benefit is that the system requires a smaller deck space which allows for a safer and less crowded work environment and provides for a reduced risk of trip and fall accidents and overboard events.

The present embodiments also eliminate the need for pre-tensioning and need for lebus grooved drum liners as with current armored umbilical winches. With the present embodiments, no bird caging or subsequent umbilical replacements are required.

The embodiments utilize a synthetic rope that is neutrally buoyant in water so that the depth capacity of the system has no impact on LARS structure capacity. In event of damage, synthetic ropes can be field spliced.

The embodiments can provide a continuous umbilical or tether direct to the ROV.

The continuous umbilical increases reliability and eliminates the need for an electrical and fiber optic rotary slip ring at the TMS. The present embodiments have significantly fewer connections and fewer parts and systems than current systems.

Fewer connections and parts means that troubleshooting is simplified and downtime and repair costs are reduced.

The continuous umbilical in the present embodiments allows for unlimited excursion distance from the PT-TMS as the distance is limited only by total tether length less the working depth. The present embodiments also allow for ROV touchdown monitoring from a lay vessel.

The embodiments provide simpler re-terms for the tether or umbilical. The user only needs to cut back and re-connect at the ROV or connect a whole spare umbilical or tether. Traditional tether replacements are typically a full day job; that replacement time is significantly reduced with the present embodiments.

The present embodiments include a two part independent synthetic load line. The two part independent synthetic load line prevents spinning throughout deployments to depth and automatically orients the TMS and ROV for launch and recovery. These improvements eliminate the requirement for a snubber rotator. Further, these improvements allow for passive alignment fixtures to stabilize the system from swinging during launch and recoveries. Since the present embodiments do not require latching, hanging loads can be avoided thereby minimizing bending moments on A-Frame structure.

In embodiments, a capstan or traction winch can be coupled to a low tension storage reel, thereby reducing the horsepower required since the load on the traction winch is done at constant diameter; no additional power is required regardless of the depth capacity of system. Further, the speed can be constant throughout deployments at any depth.

In embodiments, a dead end of rope can first pass through a multi-sheave actuator and be used for active heave compensation with zero inertial loads to overcome.

With the present embodiments, death and injuries to workers are mitigated during heavy weather deployment and recovery activities by stabilizing the tether management component and the attached ROV through the use of the alignment receptacles and stabs of the present invention.

With the present embodiments, the chance of death and injury to workers operating the system is lessened by lowering the tension of the load lines when compared to currently available ROV launch and recovery systems.

The embodiments eliminate hydraulic power units (HPU) completely, therefore removing costly HPU issues, such as leaks and maintenance. The all-electric embodiments reduce the possibility of environmental disasters by eliminating the need for hydraulics entirely from the system.

The present embodiments for the systems for ROV deployment comprise at least a LARS and a PT-TMS deployment frame.

In embodiments, the LARS can have at least a tether constant tension system and a crane system. The tether constant tension system can be devised to maintain back tension on tether from PT-TMS. In further embodiments, the tether can be controlled by a sliding or pivoting sheave control with weight or use of slip clutches or torque limiters. However, any tensioning system can be used.

In embodiments, the crane system can be used to launch and recover the PT-TMS and ROV overboard. In further embodiments, the crane can be an A-frame, a gantry, or a gantry with a telescoping end. However, any cranes can be used.

The crane system further includes one or more winches connected to the load lines for the PT-TMS and ROV. In present embodiments, traction winches, capstan winches, drum winches, and double drum winches can be used. However, any winches can be used.

The crane system further includes load lines connecting the winch or winches to the PT-TMS with ROV attached to it. In present embodiments, two or more independent load lines can be used. These load lines can be soft umbilicals (such as sonar cable) or can be rope with integral electrical or fibers. In further embodiments, a single load line can be used in a two part or basket mode. In this embodiment, the load line can be connected to a winch on one end and anchored on the opposite end or the load line can be connected to two winches or a double drum winch. The load lines can also be two single load lines in a two part mode.

Turning to the PT-TMS deployment frame, the deployment frame is comprised of—at a minimum—a frame, a traction system, drive motor, a power source, and means of communication and/or control.

In embodiments, the traction system can be two or more sheaves, two or more multi-pass sheaves, a cat track system, or an offset multi-roll system (similar to a pipe straightener). However, any traction systems can be used.

In embodiments, the drive motor can drive the traction system. Electrical or hydraulic drive motors can be used, but any motor may be used as well.

The power source to drive the motor can either be in the form of a direct cable, one of or more of the load lines with integral electrics, or from a battery. However, any power source can be used.

In embodiments, the communication or control can be with or without power. If without power, the communication or control is through a direct cable or through one or more of the independent load lines. If with power, the communication or control can be through underwater wireless systems from an offshore object or the ROV. Underwater wireless communication or control can be through acoustic means or radio frequency means or optical means or other comparable systems. Herein, this type of control may be referred to as underwater wireless control means.

In embodiments, the components for the embodied systems can be built into a standard shipping container or custom frame with standard shipping container corners and dimensions. Further, the embodied systems can be mounted on top of another control cabin or container housing other accessory equipment. This reduces deck footprint and lends itself to easier installation since there is only one container to sea fasten. Vertical ISO corner clamps can be used to connect other components together.

Turning now to the Figures, FIG. 1 depicts a side view of the pass through tether management system 10 as it is used on an offshore object 2.

A tether management component 30 can be connected to the launch and recovery assembly 12 by the load lines 24*a* and 24*b*. The tether management component 30 can be connected to or in communication with a processor 6 and a power supply 7. Data storage 9 on the offshore object 2 can be connected to or be in communication with a power supply 7 on the offshore object. In embodiments, an acoustic transmitter receiver 19 can be connected to or in communication with the processor 6 on the offshore object 2 for communicating with the tether management component 30. The tether management component 30 can have a tether management component acoustic transmitter receiver 25 for communicating with the acoustic transmitter receiver 19 deployed from the offshore object 2, such as a ship.

The launch and recovery assembly 12 can have a base frame 14 for mounting removably to the offshore object 2. One or more pivot arms 16*a* can secure to the base frame 14. The pivot arms can be constructed of carbon steel, stainless steel, aluminum, or combinations thereof.

The launch and recovery system, upon instructions from the processor 6, can raise the pivot arms with actuators 17*a* and 17*b*. In embodiments, the actuators can be hydraulically or electrically driven. In further embodiments, each actuator can connect between a pivot arm and the base frame for rotating the one or more pivot arms between an onboard position and an overboard position. The plurality of actuators can be connected to or be in communication with the processor and the power supply.

The launch and recovery system 12, with instructions from the processor 6, can raise the tether management component from the deck of the offshore object 2, and then pivot the pivot arms until the tether management component is positioned overboard of the hull of the offshore object. The tether management component can then be lowered below the water surface 3.

The tether management component can latch to a remotely operated vehicle (ROV) prior to being raised; the ROV 92 and tether management component can then be deployed together into the body of water. Once in the water, the ROV 92 can de-latch from the tether management component and the ROV tether 42 can pay out through the tether management component for operation of the ROV.

Figure 2:
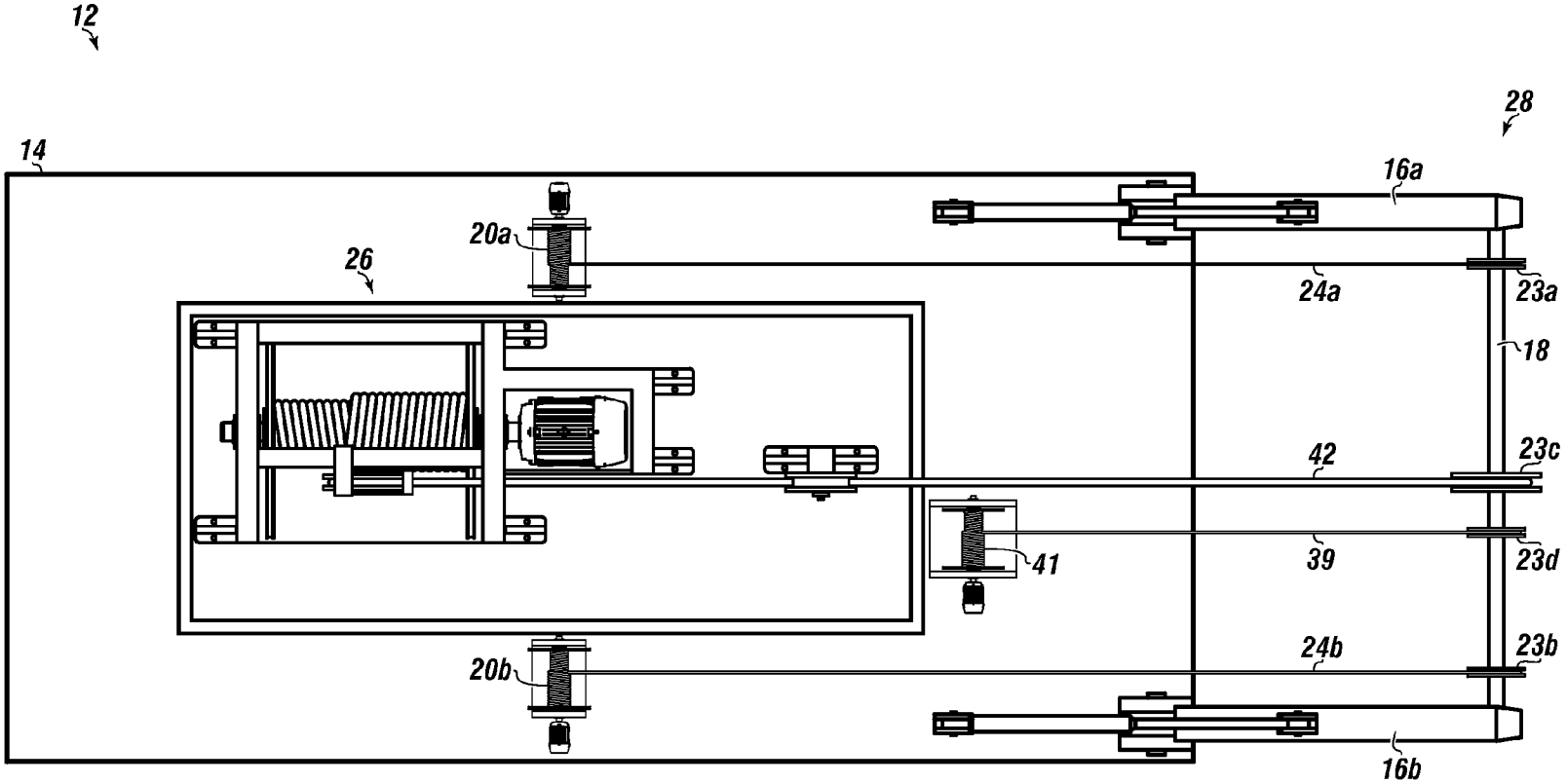
FIG. 2 depicts a top view of the launch and recovery system in an extended position.

FIG. 2 depicts a top view of the launch and recovery assembly 12 in an extended position over the base frame. Pivot arms 16*a* and 16*b* are connected by a cross member 18 secured between the pivot arms.

In embodiments, the crane system can comprise a crane and a winch. In this Figures, the crane 28 is depicted by the pivot arms 16*a* and 16*b* and sheave 23*c*. However, any type of crane with associated sheave can be used.

Winches 20*a* and 20*b* can be used for deploying or recovering load lines. A first winch 20*a* can deploy and recover a first load line 24*a*. A second winch 20*b* can deploy and recover a second load line 24*b*. In basket mode, the second winch 20*b* can connect to the opposite end of the first load line 24*a*. The first and second winches can be connected to the base frame 14. Each winch can be in communication with the processor and the power supply. A plurality of sheaves 23*a*-23*d* can be mounted to the cross member. A constant tension tether assembly 26 with the remotely operated vehicle (ROV) tether 42 connected thereto is also shown.

In embodiments, the winches can be motorized.

A communication and/or power line 39 can be deployed from a take up reel 41 which can be connected to or in communication with the processor and/or the power supply.

Figure 3:
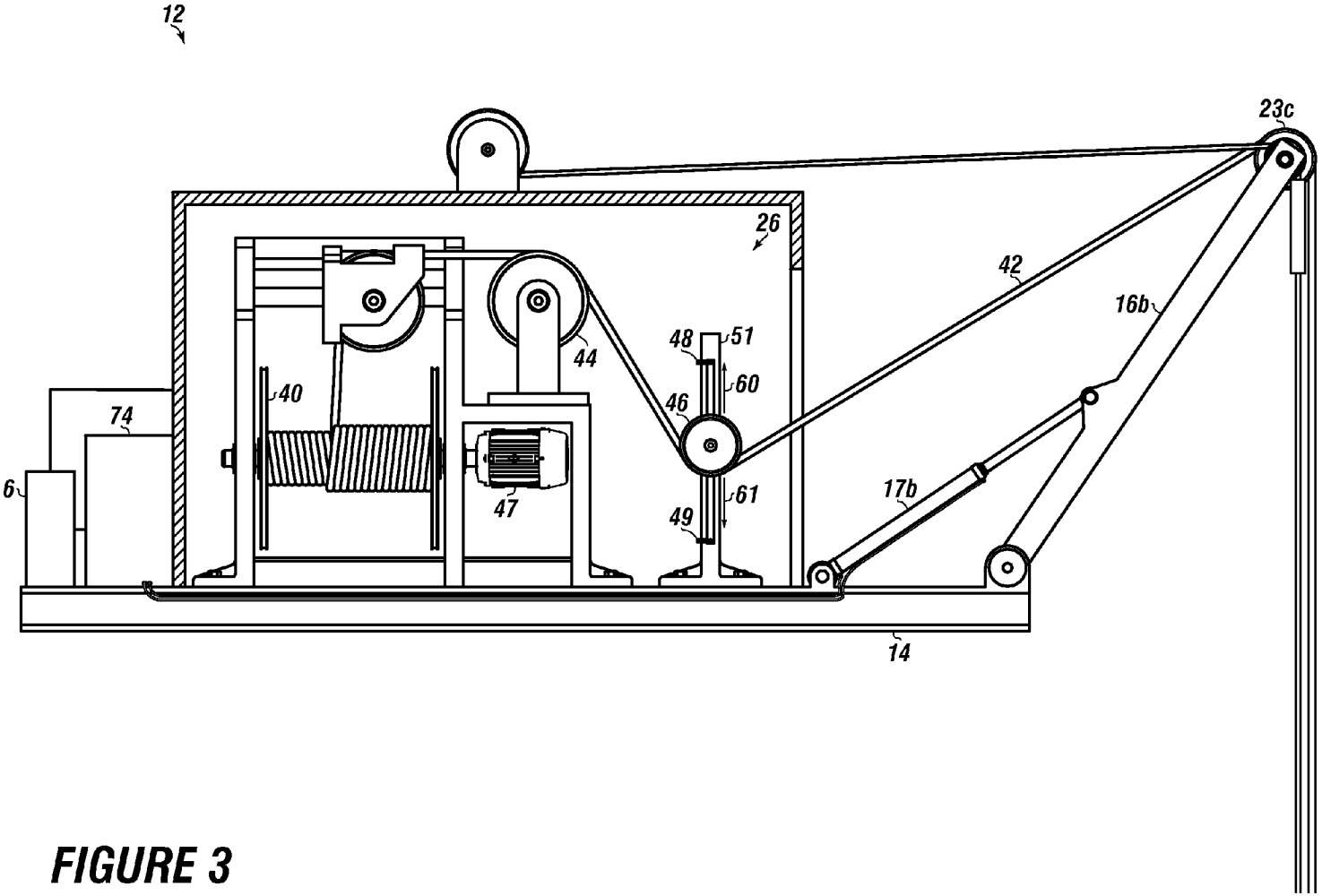
FIG. 3 depicts a side view of an embodiment of the launch and recovery assembly.

FIG. 3 depicts a side view of an embodiment of the launch and recovery assembly.

A base frame 14, shown as rectangular in the figure, can be fastened to the offshore object. In an embodiment, the base frame can be constructed of carbon steel, stainless steel, aluminum, or combinations thereof.

The remotely operated vehicle (ROV) tether 42 for paying out over a sheave can be attached to the cross member.

A constant tension tether assembly 26 for paying in and out of an ROV tether 42 is shown. The constant tension tether assembly 26 can communicate with the processor.

The constant tension tether assembly can have a movable sheave 46 for receiving the ROV tether from a sheave 23*c* on the cross member. The constant tension tether assembly can have an upper stationary sheave 44 for receiving the ROV tether 42 from the movable sheave 46. The constant tension tether assembly can have a storage reel 40 with a motor 47 connected to or in communication with the processor 6 for receiving instructions from the processor to take up or pay out the ROV tether from the upper stationary sheave.

As the movable sheave 46 moves up, an upper limit sensor 48 can cause a signal to the processor to activate computer instructions to instruct the processor to deploy additional ROV tether 42 from the storage reel automatically using the motor 47.

As the movable sheave 46 moves down, a lower limit sensor 49 can cause a signal to the processor to activate computer instructions to take up ROV tether 42 to the storage reel automatically using the motor 47.

The actuators can move the pivoting arm from a retracted position on the base frame to an extended position to deploy the tether management component.

In embodiments, a launch and recovery assembly 12 can have a hydraulic power unit 74 connected to actuator 17*b*. The hydraulic power unit 74 can communicate electronically with a processor to operate the actuator.

The movable sheave 46 can roll up and down on a rail 51 and can be mounted at a 90 degree angle to the base frame 14. The movable sheave can slide in a first direction 60 along the rail 51 during deployment of the ROV tether causing payout of ROV tether from the storage reel and can slide in a second direction 61 on the rail 51 during recovering of ROV tether.

Figure 4B:
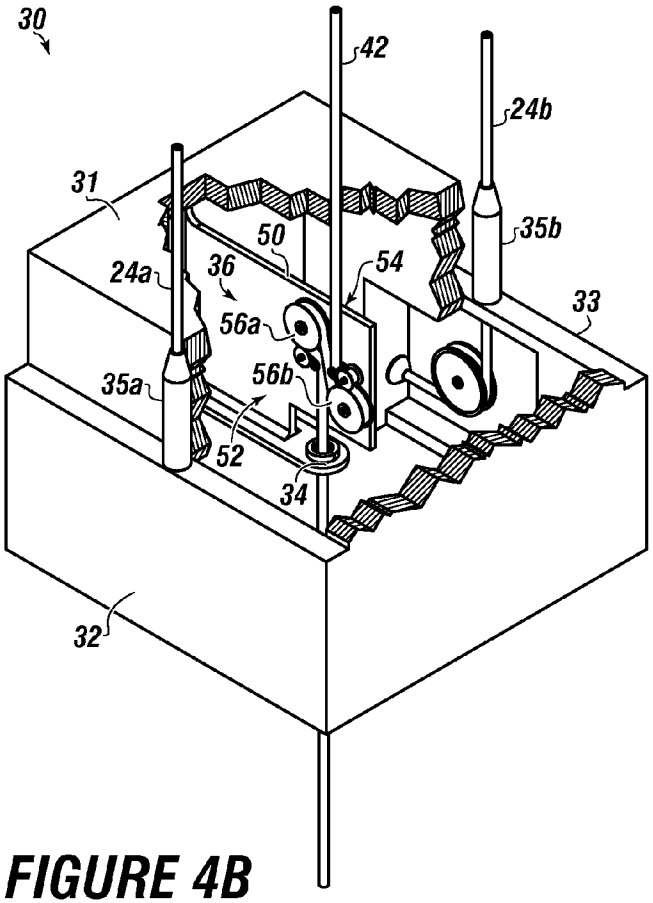
FIGS. 4A and 4B depict detailed views of an embodiment of the tether management component.
Figure 4A:
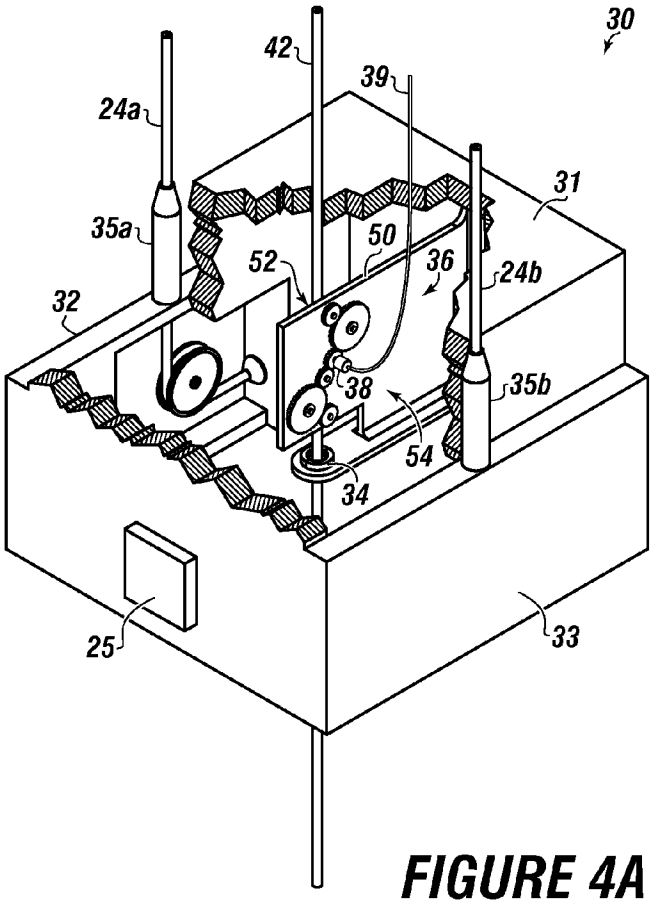

FIGS. 4A and 4B depict detailed views of an embodiment of the tether management component. The tether management component 30 can have a deployment frame 31 having a first side 32 and a second side 33.

The tether management component 30 can have a latch mechanism 34 attached to the deployment frame 31 enabling an ROV to connect to the deployment frame 31 for lifting the ROV into and out of the water using the deployment frame.

One or more stabs 35*a*, 35*b* can be mounted to the deployment frame. One of the load lines can pass through one of the stabs and anchors to the deployment frame 31. A first load line 24*a* is shown passing through stab 35*a*. A second load line 24*b* is shown passing through stab 35*b*.

A tether traction device 36 can be mounted within the deployment frame 31 for receiving ROV tether 42 from the launch and recovery assembly and for applying tension to the ROV tether using a plurality of gears connecting sheaves 56*a* and 56*b*. An electric or hydraulic motor 38 can be connected to the tether traction device and can use a communication and/or power line 39 connected to or in communication with the processor. The electric or hydraulic motor can be used for rotating gears in the tether traction device to rotate the plurality of gears connecting sheaves 56*a* and 56*b* and pay out or take up ROV tether.

A plate 50 is shown with a front side 52 and a back side 54. The plate can be secured between the first side 32 and the second side 33 of the deployment frame 31.

A tether management component acoustic transmitter receiver 25 is also shown.

The system can use the launch and recovery assembly to deploy the tether management component overboard with a connected ROV latched to the tether management component, and the system can support the tether management component with the load lines without placing load on the ROV tether.

The tether management component can be kept in the water at an operational depth so that when the ROV is disengaged from the tether management component for tethered operation, there is no need for an armored umbilical.

In embodiments, the offshore object can be a ship, such as those used in offshore oil and gas exploration, offshore object maintenance, installations, or salvage and recovery operations. In further embodiments, the offshore object can be a semisubmersible vessel, such as those used in offshore oil and gas exploration.

In embodiments, the processor and data storage can be a programmable logic controller (PLC), a computer, a laptop, a tablet, a cellular phone, a personal digital assistant, or combinations thereof.

Figure 5A:
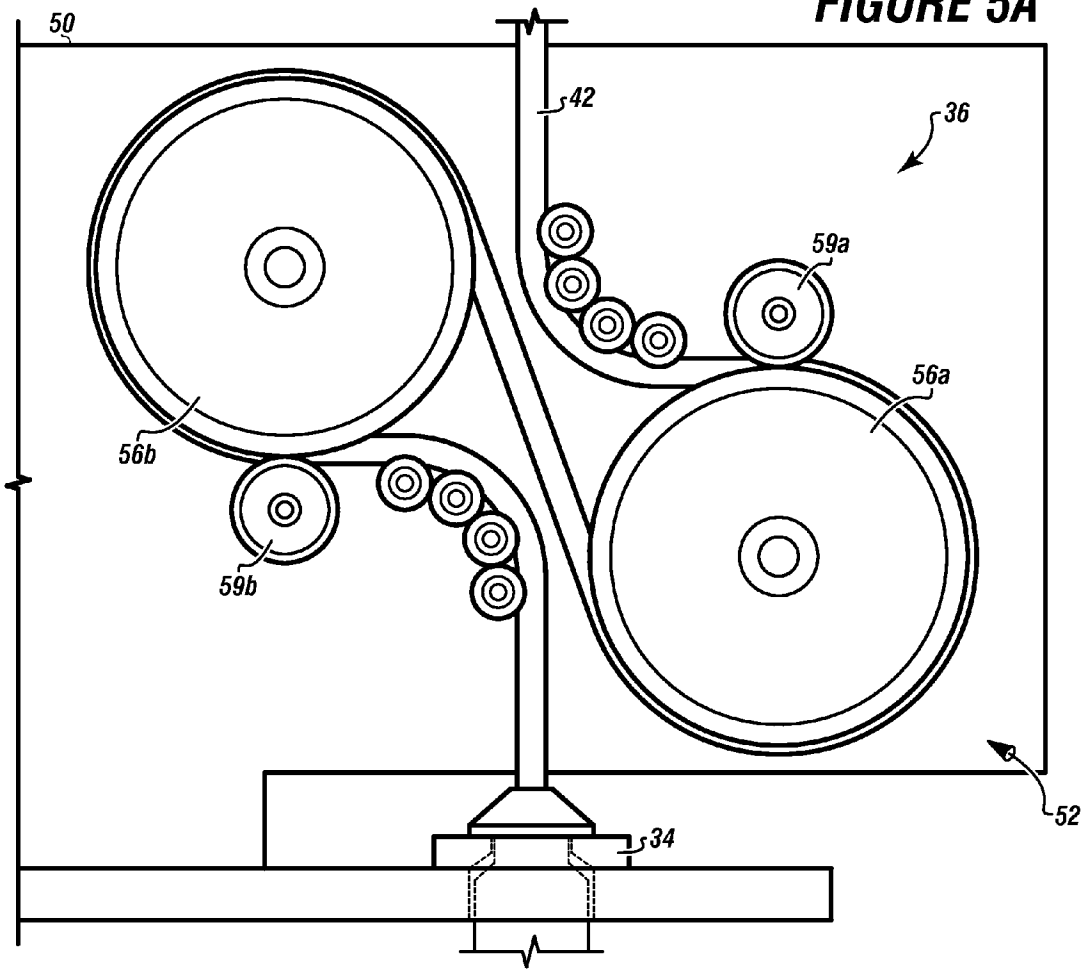
FIG. 5A depicts a detailed view of an embodiment of a tether traction device.

FIG. 5A is a detailed view of one embodiment of the tether traction device 36 mounted on a plate 50 showing the front side 52. The plurality of gears connecting sheaves 56*a* and 56*b* can be mounted in a spaced apart relationship on the front side. One or more pinch rollers 59*a*, 59*b* can be mounted to the plate. Each pinch roller can be mounted opposing a respective traction sheave.

The ROV tether 42 from the launch and recovery assembly can be received between a first pinch rollers and first gear connecting sheave. The ROV tether rolls around the first gear connecting sheave to a second gear connecting sheave, then rolls around the second gear connecting sheave to a second pinch roller opposite the second gear connecting sheave through the latch mechanism 34.

Figure 5B:
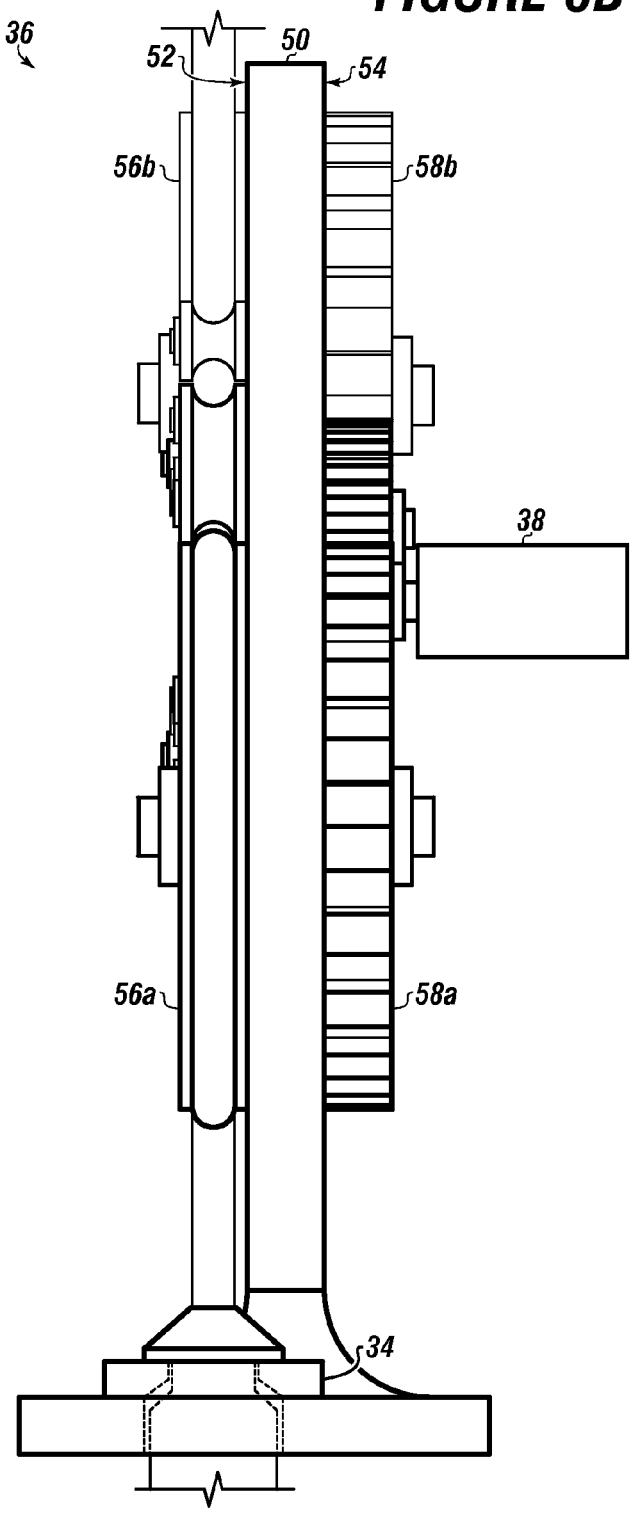
FIG. 5B depicts an end view of the embodiment of a tether traction device in FIG. 5A.

FIG. 5B depicts an end view of one embodiment of the tether traction device 36 shown in FIG. 5A used in the tether management component with gears and sheaves mounted thereto. One or more gears 58*a*, 58*b* can be mounted on a back side 54 of the plate 50 in a spaced apart relationship. The electric or hydraulic motor 38, latch mechanism 34, one or more gear connecting sheaves 56*a*, 56*b*, and front side are also shown.

Figure 6:
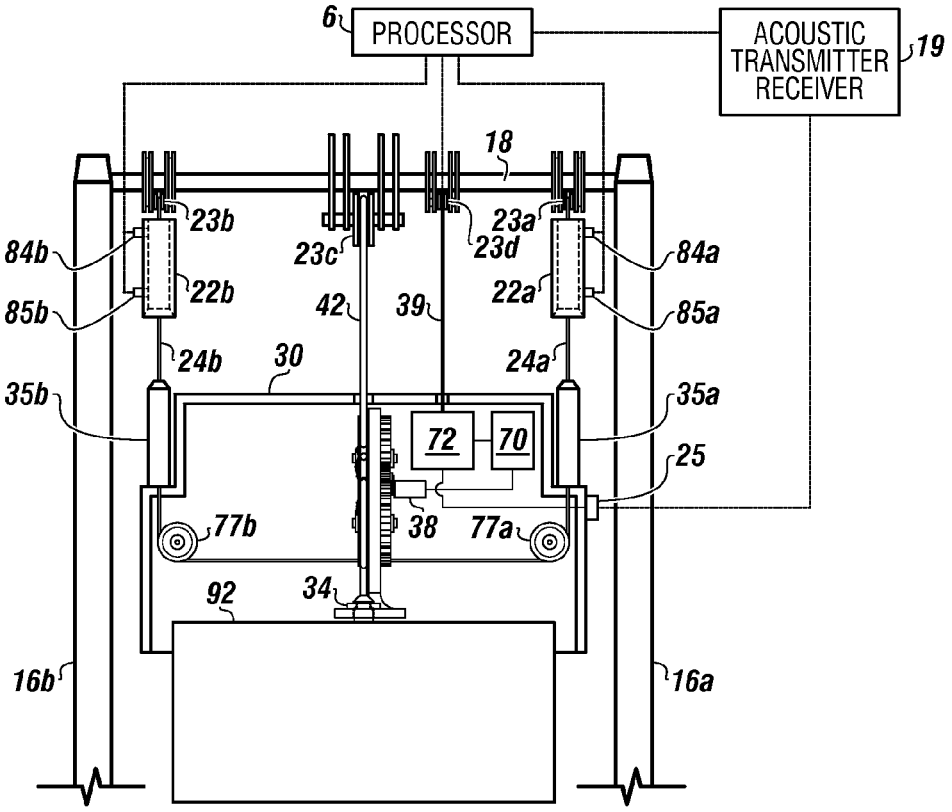
FIG. 6 depicts an embodiment of the system with a "basket mode" load line.

FIG. 6 depicts an embodiment of the system with a "basket mode" load line using the cross member secured between the pivot arms 16*a* and 16*b*.

The alignment receptacle can have an upper limit sensor 84*a* and a lower limit sensor 85*a* with each sensor connected to or in communication with the processor 6 for operating load line winches to maintain the stabs in contact with the alignment receptacles during pivoting of pivot arms 16*a* and 16*b* using computer instructions in the data storage.

The tether management component 30 is depicted with the plurality of stabs 35*a* and 35*b* in close proximity of engaging alignment receptacles 22*a* and 22*b* and where stabs position when engaging will be determined by the upper limit sensors 84*a* and 84*b* and the lower limit sensors 85*a* and 85*b*, which allows the tether management component 30 to remain in constant contact with the alignment receptacles stabilizing the tether management component 30 with attached ROV 92 during launch and recovery in heavy seas.

Sheaves 23*a*-23*d* can be mounted to the cross member 18. The first load line 24*a* can engage a winch on a first end of the load line and pass through a first sheave 23*a* into a first alignment device 22*a* then through stab 35*a* and to a first lower sheave 77*a* across to a second lower sheave 77*b* to a stab 35*b* and into a second alignment device 22*b*, a second sheave 23*b*, and to the launch and recovery system.

The upper limit sensors 84*a* and 84*b* and the lower limit sensors 85*a* and 85*b* can be connected to or in communication with the processor 6. A tether management component acoustic transmitter receiver 25 mounted on tether management component 30 coupled with acoustic transmitter receiver 19 can be connected to or in communication with the processor 6 allowing for wireless transmissions in basket mode. The acoustic transmitter receiver can be stationed at the host platform or on the ROV. The underwater wireless control means are not specifically depicted in the figure; however, one of ordinary skill in the art, and based on a reading of this detailed description, would recognize that, in at least one embodiment, the electronic based aspects of the embodiments can be implemented in the underwater wireless control means. As such, it should be noted that a plurality of hardware and software based devices, as well as a plurality of different structural components may be utilized to implement the embodiments.

The tether management component 30 can have a battery 70 connected to a control pod 72 and the electric or hydraulic motor 38 mounted to the deployment frame, wherein the control pod 72 can be in communication with the tether management component acoustic transmitter receiver 25. A communication and/or power line 39 can be connected to the control pod 72.

The launch and recovery assembly can deploy the tether management component overboard with ROV 92 connected, maintaining load on the tether management component with the load line but without placing load on the ROV tether 42, and without using an armored umbilical, then the ROV can be disengaged from the deployment frame for tethered operation while maintaining the tether management component in the water at an operational depth with the control pod adapted to receive commands from the processor 6.

Figure 7:
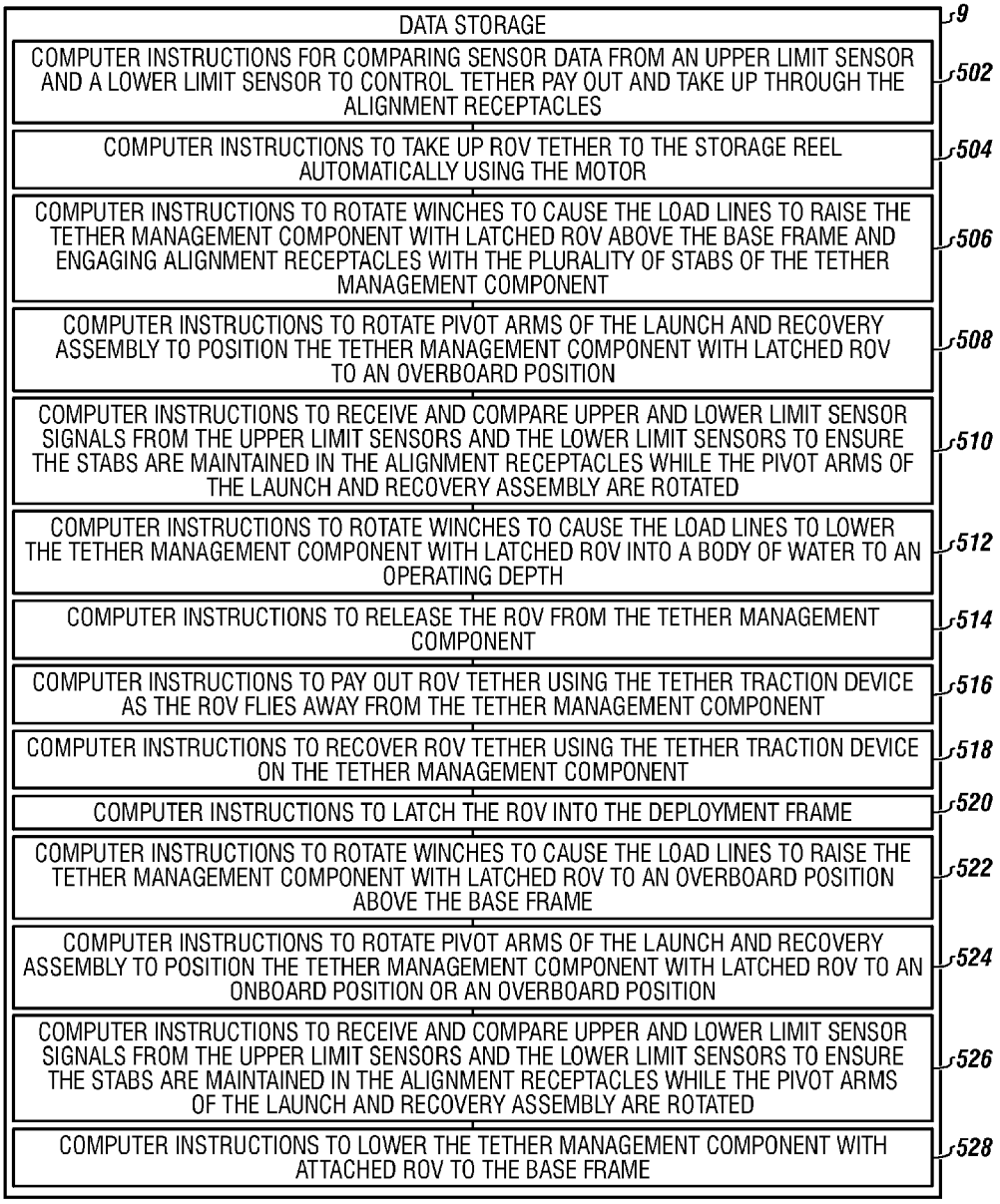
FIG. 7 depicts an embodiment of the data storage of the system.

FIG. 7 depicts the data storage of the system. The data storage can include computer instructions 502 for comparing sensor data from an upper limit sensor and a lower limit sensor to control tether pay out and take up through the alignment receptacles.

The data storage can include computer instructions 504 to take up ROV tether to the storage reel automatically using the motor. The data storage can include computer instructions 506 to rotate winches to cause the load lines to raise the tether management component with latched ROV above the base frame and engaging alignment receptacles with the plurality of stabs of the tether management component.

The data storage can include computer instructions 508 to rotate pivot arms of the launch and recovery assembly to position the tether management component with latched ROV to an overboard position.

The data storage can include computer instructions 510 to receive and compare upper and lower limit sensor signals from the upper limit sensors and the lower limit sensors to ensure the stabs are maintained in the alignment receptacles while the pivot arms of the launch and recovery assembly are rotated.

The data storage can include computer instructions 512 to rotate winches to cause the load lines to lower the tether management component with latched ROV into a body of water to an operating depth. The data storage can include computer instructions 514 to release the ROV from the tether management component. The data storage can include computer instructions 516 to pay out ROV tether using the tether traction device as the ROV flies away from the tether management component.

The data storage can include computer instructions 518 to recover ROV tether using the tether traction device on the tether management component. The data storage can include computer instructions 520 to latch the ROV into the deployment frame. The data storage can include computer instructions 522 to rotate winches to cause the load lines to raise the tether management component with latched ROV to an overboard position above the base frame.

The data storage can include computer instructions 524 to rotate pivot arms of the launch and recovery assembly to position the tether management component with latched ROV to an onboard position or an overboard position.

The data storage can include computer instructions 526 to receive and compare upper and lower limit sensor signals from the upper limit sensors and the lower limit sensors to ensure the stabs are maintained in the alignment receptacles while the pivot arms of the launch and recovery assembly are rotated. The data storage can include computer instructions 528 to lower the tether management component with attached ROV to the base frame.

In embodiments, the pass through tether management system can use an electrical cable acting as a load line for communicating from the processor and the power supply to the tether management component.

In one embodiment for the launch and recovery management systems, the systems can have cantilever telescoping arms. This embodiment can be mounted on top of control cabin or container housing with other accessory equipment to save deck space. This embodiment provides the advantage of the arms remaining above the load and provides single plane actuation. In this embodiment, the ROV can be launched or recovered sideways to save deck space and limit amount of reach required. In this orientation, electrically driven telescoping screw jacks can be used to avoid hydraulics.

This embodiment can include heave compensation with a multi-part actuator. These embodiments use a closed hydraulic system driven by a screw jack or other linear actuator to accurately drive the multi-sheave actuator. These heave compensation embodiments do not require a position sensor and do not require excessive power for inertia load when reversing the winch like with armored umbilical system. Further, the heave compensation embodiments minimize the speed and amplitude of the heave since the load is always over edge of the vessel keeping the length from the center of gravity of vessel minimal and predictable.

This embodiment can include passive guidance for heavy weather deployments. The passive guidance includes sliding stabs in the telescoping arms that intersect the PT-TMS. This aspect eliminates side loading on the LARS arms thus minimizing structural size, minimizes the swinging of system in the freeboard area, and provides for easy adaption to various moon pool installations.

This embodiment can include separate cage control around or on top of the PT-TMS which intersects rails on the side of the vessel. When separated from the PT-TMS, the separate cage becomes the rope guide. The cage extends to intersect and guide the ropes at deck level after lowering the ROV, thereby eliminating side loading and minimizing swinging.

With AHC, after deploying the ROV overboard, loads can be transferred to the PT-TMS. The landing of these loads is accomplished by simply operating winch on opposite end of rope while in AHC mode. Further, the MRU can be put directly on PT-TMS to eliminate any response time or harmonic issues.

The embodiments can include overload protection by placing a dry accumulator in the closed hydraulic system of AHC actuator. The overload protection can protect from surges up to 20 feet. The dry accumulator can be set to 125 percent of max load.

The embodiments can include run-off protection by having slip clutches integrated in LARS winch or capstan and take up reel. Using this run-off protection will prevent overloading until run out of rope. In the run-off protection, the system can be set to 150 percent max load. Further, the tether storage reel can be designed for 50 percent to 75 percent of max load.

In event of dead ROV, the ROV can be simply pulled with the LARS tether reel back through PT-TMS until bullet passively latches in frame.

The embodiments can utilize electrically driven screw jacks for AHC and telescoping LARS Arms as well as electric or air motors to drive reels and winches. The total horsepower needed to operate the system is minimized. Hydraulics are not needed, therefore, leaks and spills are eliminated and as well as the need for draining and re-filling hydraulic fluid for mobilizations. Maintenance is significantly reduced since filter changes are not required, heat exchangers are not required. Further, reliability is increased since the embodiments require fewer systems parts that could fail.

Restated, the embodiments as claimed relate to a pass through tether management system comprising a launch and recovery assembly and a tether management component. The launch and recovery assembly comprises a base frame; a crane and a winch secured to the base frame; a load line engaging the winch and passing into and through and out of a tether management component; an independent power and control line connected to the tether management component and a reel secured to the base frame; and a ROV tether secured to a constant tension tether assembly secured to the base frame. The tether management component comprises a deployment frame; a tether traction device secured to the deployment frame, wherein the tether traction device receive the ROV tether and applies tension to the ROV tether using gears and traction sheaves; and a motor connected to the tether traction device for powering the gears and traction sheaves to pay in and out the ROV tether.

Restated, the embodiments as claimed also relate to a pass through tether management system comprising a launch and recovery assembly and a tether management component. The launch and recovery assembly comprises a base frame; a crane and a winch secured to the base frame; a load line engaging the winch and passing into and through and out of a tether management component; and a ROV tether secured to a constant tension tether assembly secured to the base frame. The tether management component comprises a deployment frame; a power source and underwater wireless control means in the deployment frame; a tether traction device secured to the deployment frame, wherein the tether traction device receive the ROV tether and applies tension to the ROV tether using gears and traction sheaves; and a motor connected to the tether traction device for powering the gears and traction sheaves to pay in and out the ROV tether, wherein the motor is powered by the power source.

Restated, the embodiments as claimed also relate to a pass through tether management system comprising a launch and recovery assembly and a tether management component.

The launch and recovery assembly comprises a base frame; a crane and a double drum winch secured to the base frame; a first independent load line engaging the double drum winch and connected to a tether management component; a second independent load line engaging the double drum winch connected to the tether management component, wherein the second independent load line supplies power and control to the tether management component; and a ROV tether secured to a constant tension tether assembly secured to the base frame. The tether management component comprises a deployment frame; a tether traction device secured to the deployment frame, wherein the tether traction device receive the ROV tether and applies tension to the ROV tether using gears and traction sheaves; and a motor connected to the tether traction device for powering the gears and traction sheaves to pay in and out the ROV tether.

In each claimed embodiment, the launch and recovery assembly deploys the tether management component overboard with an ROV connected and supports the tether management component with the load line, wherein the ROV is disengaged from the deployment frame for tethered operation while maintaining the tether management component at an operational depth.

While these embodiments have been described with emphasis on the embodiments, it should be understood that within the scope of the appended claims, the embodiments might be practiced other than as specifically described herein.

What is claimed is:

1. A pass through tether management system comprising:

a. a launch and recovery assembly comprising:

(i) a base frame;

(ii) a crane and a winch secured to the base frame, wherein the crane further comprises a plurality of alignment receptacles, wherein each alignment receptacle has an upper limit sensor and a lower limit sensor;

(iii) at least one load line engaging the winch passing into and through and out of a tether management component and returning to the base frame;

(iv) at least one communication and/or power line connected to the tether management component and a take up reel secured to the base frame; and (v) a remotely operated vehicle tether secured to a constant tension tether assembly secured to the base frame; and b. the tether management component comprising:

(i) a deployment frame;

(ii) a tether traction device secured to the deployment frame, wherein the tether traction device receive the remotely operated vehicle tether and applies tension to the remotely operated vehicle tether using a plurality of gears connecting sheaves; and (iii) a motor connected to the tether traction device for powering the plurality of gears connecting sheaves to pay in and out the remotely operated vehicle tether; and wherein the launch and recovery assembly deploys the tether management component overboard with an remotely operated vehicle connected and supports the tether management component with the at least one load line, wherein the remotely operated vehicle is disengaged from the deployment frame for tethered operation while maintaining the tether management component at an operational depth.

2. The system of claim 1, wherein the at least one load line is anchored at the base frame or to an additional winch located on the base frame.

3. The system of claim 1, wherein the crane is an A-frame style crane or a gantry with telescoping arms.

4. A launch and recovery assembly comprising:

(i) a base frame;

(ii) a crane and a winch secured to the base frame, wherein the crane further comprises a plurality of alignment receptacles, wherein each alignment receptacle has an upper limit sensor and a lower limit sensor;

(iii) at least one load line engaging the winch passing into and through and out of a tether management component and returning to the base frame; and (iv) a remotely operated vehicle tether secured to a constant tension tether assembly secured to the base frame; and b. the tether management component comprising:

(i) a deployment frame;

(ii) a power source and underwater wireless control means in the deployment frame;

(iii) a tether traction device secured to the deployment frame, wherein the tether traction device receives the remotely operated vehicle tether and applies tension to the remotely operated vehicle tether using a plurality of gears connecting sheaves; and (iv) a motor connected to the tether traction device for powering the using the plurality of gears connecting sheaves to pay in and out the remotely operated vehicle tether, wherein the motor is powered by the power source; and wherein the launch and recovery assembly deploys the tether management component overboard with an remotely operated vehicle connected and supports the tether management component with the at least one load line, wherein the remotely operated vehicle is disengaged from the deployment frame for tethered operation while maintaining the tether management component at an operational depth.

5. The assembly of claim 4, wherein the at least one load line is anchored at the base frame or to an additional winch located on the base frame.

6. The assembly of claim 4, wherein the crane is an A-frame style crane or a gantry with telescoping arms.

7. A pass through tether management system comprising:

a. a launch and recovery assembly comprising:

(i) a base frame;

(ii) a crane and a double drum winch secured to the base frame, wherein the crane further comprises a plurality of alignment receptacles, wherein each alignment receptacle has an upper limit sensor and a lower limit sensor;

(iii) a first independent load line engaging the double drum winch and connected to a tether management component;

(iv) a second independent load line engaging the double drum winch connected to the tether management component, wherein the second independent load line supplies power and control to the tether management component; and (v) a remotely operated vehicle tether secured to a constant tension tether assembly secured to the base frame; and b. the tether management component comprising:

(i) a deployment frame;

(ii) a tether traction device secured to the deployment frame, wherein the tether traction device receives the remotely operated vehicle tether and applies tension to the remotely operated vehicle tether using a plurality of gears connecting sheaves; and (iii) a motor connected to the tether traction device for powering the plurality of gears connecting sheaves to pay in and out the remotely operated vehicle tether; and wherein the launch and recovery assembly deploys the tether management component overboard with a remotely operated vehicle connected and supports the tether management component with the first independent load line, the second independent load line, or combinations thereof, wherein the remotely operated vehicle is disengaged from the deployment frame for tethered operation while maintaining the tether management component at an operational depth.

8. The system of claim 7, wherein the first independent load line supplies power and control to the tether management component.

9. The system of claim 7, wherein the crane is an A-frame style crane or a gantry with telescoping arms.

10. The system of claim 7, wherein the double drum winch is a first winch and a second winch.

* * * * *